United States Patent [19]

Smyers

[11] Patent Number: 4,946,390

[45] Date of Patent: Aug. 7, 1990

[54] CABLE TERMINATION ASSEMBLY WITH CONTACT SUPPORTING HOUSING AND INTEGRALLY MOLDED STRAIN RELIEF

[75] Inventor: Joseph S. Smyers, Mentor, Ohio

[73] Assignee: Minnesota Mining & Manufacturing Co., Saint Paul, Minn.

[21] Appl. No.: 441,339

[22] Filed: Nov. 22, 1989

Related U.S. Application Data

[63] Continuation of Ser. No. 372,197, Jun. 26, 1989, abandoned, which is a continuation of Ser. No. 215,034, Jul. 5, 1988, abandoned.

[51] Int. Cl.[5] ..... H01R 4/24

[52] U.S. Cl. ..... 439/404; 439/736

[58] Field of Search ..... 439/389–424, 439/736

[56] References Cited

U.S. PATENT DOCUMENTS

| | | |
|---|---|---|
| 2,700,206 | 1/1955 | Gilbert . |
| 2,701,867 | 2/1955 | Obenschain et al. . |
| 3,274,533 | 9/1966 | Apted et al. . |
| 3,905,665 | 9/1975 | Lynch et al. . |
| 3,930,708 | 1/1976 | Wedekind et al. . |
| 4,030,799 | 6/1977 | Venaleck . |
| 4,094,564 | 6/1978 | Cacolici . |
| 4,596,428 | 6/1986 | Tengler . |
| 4,722,692 | 2/1988 | Tengler et al. . |
| 4,725,243 | 2/1988 | Pretchel et al. . |
| 4,726,115 | 2/1988 | Hartman . |
| 4,767,352 | 8/1988 | Pretchel . |
| 4,776,803 | 10/1988 | Pretchel et al. . |
| 4,798,544 | 1/1989 | Hartman . |
| 4,869,684 | 9/1989 | Cloud et al. . |

*Primary Examiner*—Joseph H. McGlynn

*Attorney, Agent, or Firm*—Renner, Otto, Boisselle, & Sklar

[57] ABSTRACT

A cable termination assembly, and a mold and method of molding the same, includes an electrical cable including at least one conductor, at least one electrical contact, a support body for at least preliminarily supporting the electrical contact, the electrical contact having an insulation displacement connection portion, and a contacting portion, and the support body and contact cooperating during insulation displacement connection connecting of the insulation displacement connection portion to such conductor. Part of the electrical contact and the support body cooperate during the mentioned molding to effect a shut off function blocking flow of molding material of the strain relief into an area of the support body where the contacting portion is located.

23 Claims, 7 Drawing Sheets

CABLE TERMINATION ASSEMBLY WITH CONTACT SUPPORTING HOUSING AND INTEGRALLY MOLDED STRAIN RELIEF

This is a continuation of co-pending application Ser. No. 07/372,197 filed on June 26, 1989, now abandoned, which is a continuation of Ser. No. 07/215,034, filed on July 5,1988, now abandoned.

TECHNICAL FIELD

The present invention relates generally, as indicated, to electrical interconnection devices and methods and, more particularly, to such devices and methods using integral molding. The invention is particularly suited to the field of mass termination connectors.

BACKGROUND

In the art of electrical connectors or electrical interconnection devices for cables and the like, the term cable termination typically means a connector that is or can be used at the end or at an intermediate portion of a cable to connect the conductor or conductors thereof to an external member or members, such as another connector, cable termination, printed circuit board, or the like. Such external member usually is part of or can be connected to at least part of another electrical device, circuit, or the like; in any event, the objective is to effect electrical interconnections of respective circuits, lines, conductors, etc. A cable termination assembly is usually referred to as a combination of a cable termination with an electrical cable. Sometimes the terms cable termination and cable termination assembly equivalently are interchanged, depending on context.

The invention is described in detail below with respect to use of the principles of the invention in a multiconductor cable termination assembly. Such cable termination assembly may be used to connect the conductors of a multiconductor cable, for example, a flat ribbon multiconductor cable (or any other electrical cable) to an external member, e.g., as was noted above. The actual cable termination may take the form of a socket or female connector type structure, a card edge connector, and other forms that are well known, as well as those forms that may be developed in the future.

The discussion below relating to the preferred embodiment of the invention is directed to a multiconductor cable termination assembly. It will be appreciated, nevertheless, that the principles of the invention may be used with a cable having only a single conductor or an assemblage of cables, each having one or more conductors.

Multiconductor electrical cable termination assemblies have been available for a number of years. These cable termination assemblies, in fact, have been available in unassembled form requiring mechanical assembly thereof, which includes the mechanical clamping of the termination properly to secure the various elements of the termination and the cable. These cable termination assemblies also have been available as a permanent preassembled and molded integral structural combination. Examples of such cable termination assemblies are found in U.S. Pat. No. 3,444,506 and in U.S. Pat. No. 4,030,799, respectively.

In both such patents and the techniques disclosed therein, the junctions or connections of contacts with respective conductors of the cable are made by part of the contacts piercing through the cable insulation to engage a respective conductor. Such a connection is referred to as an insulation displacement connection (IDC).

Unfortunately, contamination of the IDC junctions, e.g., due to dirt, corrosion and the like, can detrimentally affect the junctions, e.g., causing a high impedance, an open circuit or the like. The mechanically assembled types of prior cable terminations are particularly susceptible to such consquences. The directly molded cable termination assemblies are less susceptible to contamination because of a molded hermetic seal or near hermetic seal surrounding the junctions of the cable conductors and contacts. Examples of such directly molded cable termination assemblies are presented in U.S. Pat. No. 4,030,799 and in U.S. patent application Ser. No. 901,762, for "Improved Jumper Connector", filed Aug. 28, 1986, the disclosures of which are hereby incorporated in their entireties.

One common aspect of both the mechanically assembled cable termination assemblies and the directly molded type is the required assembling step or steps and the separate parts fabrications. These are labor and time consuming and, thus, are relatively expensive. For example, the mechanically assembled devices require the separate molding of several parts followed by assembling thereof. Even in the directly molded device of the '799 patent, to make a socket connector illustrated therein it is necessary to provide a separately molded cover, to install it over the contacts, and then to secure it, e.g., by ultrasonic welding, to the molded base. It would, of course, be desirable to minimize such mechanical assembly and welding steps and attendant costs. Such elimination of the welding is most desirable because the weld is an area of low strength, and to help assure success of a weld it often is necessary to make the parts of the connector of relatively expensive virgin plastic material.

A number of types of electrical contacts are available for use in electrical connectors. Often the contacts are categorized either as a male contact or as a female contact; and a connector or cable termination using male contacts would be categorized as a male connector while a connector using female contacts would be categorized as a female or socket connector. A typical example of a male contact is that known as a pin contact. A pin contact usually is a relatively rigid straight member that is not particularly compliant relative to a female contact. Pin contacts often are inserted into female contacts to make electrical connections therewith; sometimes pin contacts are inserted into holes in a printed circuit board and usually are soldered in place to connect with printed circuits on the board. Another example effectively of a male contact would be the printed circuit traces or portions on a printed circuit board to which an edge board connector or the like may be connected. A female contact may be of the cantilever type, fork type, box type, resilient wiping type, bow type, and so on. Usually a female contact is relatively resilient and relatively compliant compared to a male contact. When a male contact and a female contact are moved relative to each other or are inserted relative to each other, usually there is some deformation of the female contact in response to engagement with the male contact, and often there is a wiping of the contacts against each other as they are brought together to form an electrical connection therebetween.

One type of female contact, the fork contact, is disclosed in U.S. Pat. No. 4,030,799. A molding method disclosed in such patent is that which sometimes is referred to as insert molding, and such method provides an integral structure of the contacts, cable and strain relief material. For such insert molding method, electrical contacts are placed in a mold, a multiconductor cable is placed relative to the contacts and mold, the mold is closed to effect IDC connections of the cable conductors and contacts and to close the mold cavity, and the molding material then is injected into the mold. The fork contacts mentioned are generally planar contacts in that the major extent thereof is in two directions or dimensions (height and width), and the thickness is relatively small; this characteristic makes the fork contacts particularly useful for insert molding.

Other types of electrical contacts are referred to as three-dimensional contacts. An example is that used in some connectors sold by Minnesota Mining and Manufacturing Company and sometimes referred to as a Hi-Rel contact. Such contact has an inverted U-shape. One leg of the U is connected to a base portion of the contact, which base portion in turn is connected to an IDC portion. The other leg of the U is bent out of the plane of the first leg and base to form a resiliently deformable cantilever contacting portion. The contact ordinarily is placed relative to a socket, cell or chamber into which a pin contact may be inserted to engage the cantilever arm or contacting portion. There are a number of advantages to such three-dimensional contacts, including, for example, the relatively large surface available to engage an inserted pin contact and the relatively large compliance factor allowing a large bending capability of the cantilever contacting portion without overstressing the same.

Such three dimensional contacts have been used in mechanically assembled cable termination assemblies in the past, for the complexities of the assembly housing and the various needs of the contact for alignment and support were not provided in a directly molded cable termination assembly configuration.

For a number of the above and possibly other reasons, then, it is desirable to use IDC connections in a cable termination assembly and to directly mold strain relief material. Problems encountered in attempting to accomplish both such goals include difficulties in providing support of the contact during molding (for both placement accuracy and avoiding damage to the contacting portion of the contact, especially if the contact is of the three dimensional type) and in providing a shut off to prevent strain relief material from reaching and interfering with the contacting portion.

BRIEF SUMMARY OF THE INVENTION

The present invention enables and represents the merging of advantages, features and components of the insert molding techniques, cable terminations and assemblies with advantages, features and components of the mechanically assembled terminations and assemblies, especially with three-dimensional contacts, and, especially, intends to achieve both goals while avoiding the problems mentioned above.

In accordance with the present invention, a multiconductor cable termination assembly has junctions between the cable termination contacts and the cable conductors, a housing cover or cap (sometimes referred to as a support body) in which the contacts at least preliminarily are supported, and a strain relief body directly molded to at least part of the cable, contacts, junctions thereof, and cover. Preferably, the junctions are IDC junctions. Preferably, too, the contacts are three dimensional.

Such merging, at least in part, is possible by using a cooperative relation between the contacts and a premolded housing cover or cap of the cable termination assembly into which the contacts are placed prior to molding the strain relief to shut off cells in the cover where working (contacting) portions of the contacts are located. This shut off function allows the strain relief body to be molded directly to the cover, contacts, junctions and cable. Moreover, the cover has means to cooperate with the contacts to support the same in proper position for IDC connections prior to molding of the strain relief and to support the contacts during molding while avoiding damage to the contacting portions.

The junctions of such cable termination assembly are secure, the molded strain relief assuring that the contacts and cable are held in relatively fixed positions; and the junctions of the contacts and cable conductors are hermetically sealed within the strain relief body to avoid contamination that otherwise potentially could damage the conductivity or effectiveness of connection. The strain relief body holds the cable, contacts, and cover securely as an integral structure providing a strong cable termination assembly.

Also in accordance with the present invention, a method for making a cable termination assembly includes the initial supporting of one or more contacts in a cover or housing, effecting IDC junction connections between the contacts and respective cable conductors, and molding the strain relief directly to at least part of the cable, contacts, and cover or housing. Importantly, the contacts have a portion intended to cooperate with the cover to provide a shut-off function to block entry of molding material into at least part of the cover during the molding process. This shut-off feature isolates the molded-in end of the contact from the working or contacting end.

The various features of the invention may be used in electrical connectors, primarily of the cable termination or cable termination assembly type, as well as with other electrical connectors. The features of the invention may be used to effect an interconnection of the conductor of a single conductor cable to an external member or to connect plural conductors of a multiconductor cable or assemblage of cables to respective external members. The detailed description below ,will be directed to a multiconductor cable termination assembly including and for a flat ribbon cable having a plurality of conductors therein. The invention is useful primarily with female-type contacts, socket connectors, card edge connectors, as are described herein; however, the principles of the invention may be employed with contacts other than those of the female type and with other connectors as well.

With the foregoing and following detailed description in mind, one aspect of the invention relates to an electrical connector including at least one electrical contact, a support body for at least preliminarily supporting the contact, and a strain relief body directly molded to at least part of the contact and support body to form an integral structure therewith. Moreover, consistent with this aspect of the invention, another aspect includes the use of an electrical cable with the connector to form a cable termination assembly, the strain relief body being directly molded to at least part of the contacts, cable, and support body. Still further, preferably the support body is the housing for the contacting portions of the connector.

Another aspect relates to a method of making an electrical connector including placing an electrical contact in the support body of the connector, and molding a strain relief body directly to at least part of the contact and the support body, the molding including using cooperative portions of at least part of the contact and support body to provide a shut off function with respect to the support body and/or a contacting portion of the contact.

Moreover, a further aspect relates to the effecting of an IDC connection between part of the contact and an electrical cable while the contact is supported in the housing cover of a connector, and the molding including molding material also about at least part of the cable, including the junctions of the contact and cable conductor.

An additional aspect relates to a cable termination assembly including at least one electrical contact, a support body for at least preliminarily supporting the contact, the contact having an IDC portion, a contacting portion, and a support portion, and the support body having a wall or surface for cooperating with the support portion to support the latter during IDC connection of the IDC portion to a conductor and preferably also during molding of a strain relief body with respect to the support body, cable and contact.

Still an additional aspect relates to a method of making a cable termination assembly including placing an electrical contact in the support body portion of the assembly, the contact having an IDC portion, a contacting portion, and a support portion between such portions, and supporting the support portion by part of the support body while effecting IDC connection of an electrical conductor and the IDC portion.

Yet an additional aspect related to those in the two previous paragraphs includes the direct molding of a strain relief body to at least part of the contact, junction, and support body of the assembly forming an integral structure therewith and preferably also forming a hermetic seal about the junctions.

The foregoing and other objects, advantages and aspects of the invention will become more apparent from the following description.

To the accomplishment of the foregoing and related ends, the invention, then, comprises the features hereinafter fully described and particularly pointed out in the claims, the following description and the annexed drawings setting forth in detail certain illustrative embodiments of the invention, these being indicative, however, of but several of the various ways in which the principles of the invention may be employed.

BRIEF DESCRIPTION OF THE DRAWINGS

In the annexed drawings, wherein FIGS. 1–3 and 20–34 show a dual-in-line cable termination assembly and FIGS. 4–19 show a single row cable termination assembly:

FIG. 1 is a side elevation view of a cable termination assembly in accordance with the present invention;

FIGS. 2 and 3 are, respectively, top and bottom views of the cable termination assembly looking in the direction of the respective arrows of FIG. 1;

FIG. 4 is a partial side elevational section view looking generally in the direction of the arrows 4—4 of FIG. 2; note that FIGS. 4–19 are related to the embodiment of FIGS. 1–3 but are simplified for convenience to show only a single row contact design, the dual-in-line configuration being evident from the disclosure hereof;

FIG. 5 is a fragmentary top view of the support body or cover portion of the assembly with contacts omitted;

FIGS. 6, 7 and 8 are section views, as indicated, taken from FIG. 5 with contacts in place;

FIG. 9, is a fragmentary bottom view of the support body of FIG. 6;

FIG. 11 is a front elevation view of an alternate contact;

FIGS. 12 and 13 are fragmentary side and top views of a shut off strip;

FIGS. 14–18 are, respectively, views similar to FIGS. 5–9, using another alternate form of contact and openings in the support body;

FIG. 19 is a schematic illustration of the support body of FIGS. 14–18 showing the technique for molding same;

FIG. 20 is a side elevation section view, partly broken away, of another cable termination assembly according to the present invention;

FIG. 21 is a section view of the cable termination assembly of FIG. 20 looking generally in the direction of the arrows 21—21 of FIG. 20—the left-hand contact cell in the cable termination assembly of FIG. 21 is shown for convenience without an electrical contact therein, and the right-hand contact cell is shown with an electrical contact therein;

FIG. 22 is a section view of the cable termination assembly looking generally in the direction of arrows 22—22 of FIG. 21;

FIG. 23 is a side elevation view of a contact carrier support for the cable termination assembly of FIG. 20.

FIG. 24 is an end elevation view of a contact carrier support of FIG. 23, looking generally in the direction of the arrows 24—24 of FIG. 23;

FIG. 25 is a top or back view of the contact carrier support;

FIGS. 26 and 27 are fragmentary plan and end views of the contacts used in the assembly of FIG. 20 prior to the forming of the contacts;

FIG. 28 is an enlarged side view of a formed contact used in the cable termination assembly of FIG. 20;

FIGS. 29, 30, 31, and 32 are, respectively, side, end section, bottom, and top views of the cover for the cable termination assembly of FIG. 20; and FIGS. 33 and 34 are, respectively, partial schematic front and end views of a molding machine for making cable termination assemblies according to the invention.

DESCRIPTION OF THE PREFERRED EMBODIMENT

Figure 2:
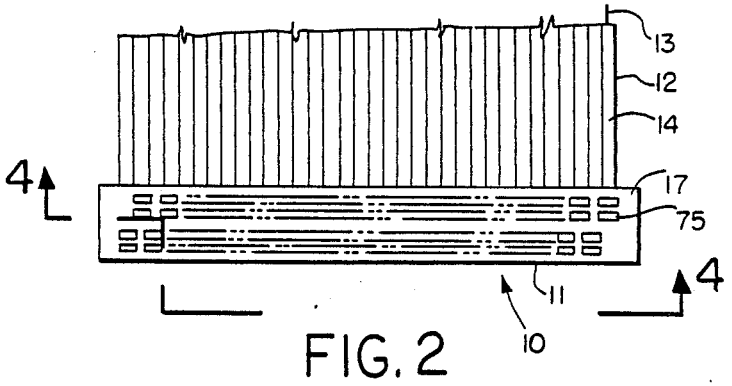
Figure 1:
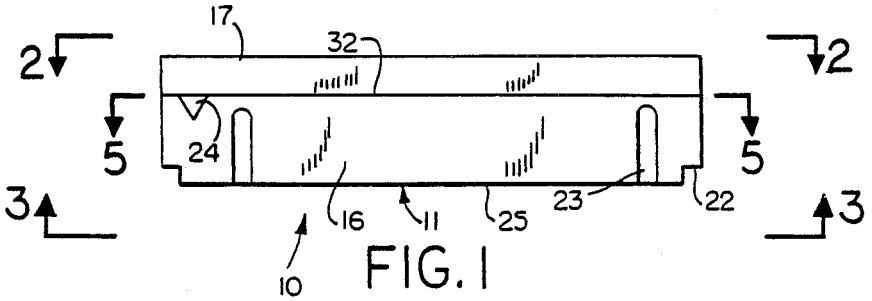
Figure 3:
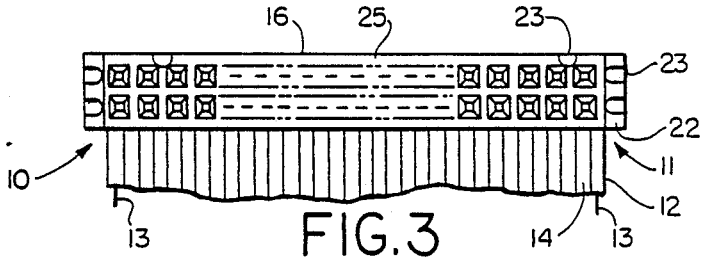

Referring, now, in detail, to the drawings, wherein like reference numerals designate like parts in the several figures, and initially to FIGS. 1 through 7, a cable termination assembly in accordance with the present invention is designated 10. The assembly 10 is illustrated in FIGS. 1–3 in dual-in-line configuration, and in FIGS. 4–7 in single row configuration to exemplify that the assembly may include one, two or more rows of contacts. Both embodiments illustrated are referred to as the same assembly 10.

The cable termination assembly 10 includes a cable termination 11 and a multiconductor flat ribbon cable 12, for example, of conventional type. Such cable 12 includes a plurality of electrical conductors 13 arranged in a generally flat, spaced-apart, parallel-extending arrangement and held relative to each other by the cable insulation 14. The conductors may be copper, aluminum, or other conductive material. The insulation 14 may be polyvinyl chloride (PVC) or other material capable of providing an electrical insulation function desired. It will be appreciated that although the cable is shown as a multiconductor cable, principles of the invention may be employed with a single conductor cable. Moreover, although the multiconductor cable preferably is in the form of a flat ribbon cable, the cable configuration may be of other style, and, in fact, the multiconductor cable may be formed of a plurality of single conductor cables assembled together.

The cable termination assembly 10 is capable of effecting a mass termination function for the plurality of conductors 13 in the multiconductor cable 12.

The fundamental components of the cable termination assembly 10 include the cable termination 11 and cable 12 and the cable termination 11 includes a plurality of electrical contacts 15, a cap (support body) 16, and a strain relief 17. The cap 16 serves as a preliminary support for the contacts 15 prior to molding of the strain relief body 17. The cap 16 also provides a plurality of cells 20 to guide pin contacts or the like for engagement with respective contacts 15 and to help support the electrical contacts 15 for such engagement. The electrical contacts 15 are electrically connected relatively permanently to respective conductors 13 of the cable 12 at respective insulation displacement connection (IDC) junctions 21; and the electrical contacts 15 also include a portion for relatively non-permanently connecting with another member, such as a pin contact, that can be inserted to engage and can be removed from engagement with respect to the electrical contact. The strain relief body 17 is directly molded about and/or to part of the contacts 15, part of the cap 16, and the junctions 21 to form therewith an integral structure as is described further below.

The cap preferably is formed by plastic injection molding techniques. The material of which the cap is made may be plastic or other material that can be plastic injection molded, and such material may include glass fiber material for reinforcement, as is well known. Various steps, polarizing, keying, etc., means may be provided at the outer surface or surfaces (or elsewhere) in the cap 16. For example, a step 22, a slot 23, and an angular indicator 24 for pin 1 position are illustrated in FIG. 1 for such purposes.

Within the cap 16 are formed a plurality of cells 20. Such cells or chambers 20 are formed in such a way as to provide desired support and positioning functions for the contacts 15 and to guide a pin contact or other external member into the cell for making an electrical connection with the contacts 15 therein. At the front end 25 of the cap 16 are tapered holes or openings 26 leading into the contacting area 27 of each cell into which a pin contact can be inserted for electrical connection with a respective electrical contact 15. Such electrical connection ordinarily is non-permanent, especially relative to the permanency of the IDC junctions 21, in that in the usual case it is expected that the pin contact could be withdrawn from the cell 20.

Each cell 20 includes both the contacting area 27, a positioning area 30, and an interior wall surface 31. The contacting area 27 is where a pin contact may be inserted to engage the electrical contact 15. The positioning area 30 helps properly to position the contact 15 in the cell 20 for the further steps described below in manufacturing the cable termination assembly 10 and for proper orientation of the contact 15 for subsequent use of the cable termination assembly 10. The wall surface 31 provides a contact support function described in greater detail below.

The contacting area 27 of each cell 20 extends fully between the front 25 and the back 32 of the cap 16. The positioning area 30 of each cell extends from a location adjacent the wall surface 31 relatively proximate the front 25 (but just behind the juncture of the tapered opening 26 with the contacting area 27) to the back 32 of the cap 16. For purposes of this description, the length of each cell is the vertical direction with respect to FIG. 6; the width of each cell is the horizontal direction depicted in FIG. 6, and the thickness of each cell is the dimension into or normal with respect tot he plane of the paper relative to the illustration of FIG. 6. The thickness and width of the contacting area 27 are approximately equal to form a generally square cross-sectional area normal to the height of each contacting area 27 of each cell 20. The width of the positioning area 30 is about the same as the width of the contacting area 27. However, the thickness of the positioning area 30 is smaller than the thickness of the contacting area so as to provide a relatively close fit for part of the contact 15 to accomplish the desired positioning function, as will be described further below. Such close fit also in part preferably helps provide shut off function during molding of the strain relief so molding material is blocked from the contacting area.

The strain relief body 17 is molded directly to the back end 32 of the cap 16, and such molding material tends to knit with such cap. The cells 20 are arranged in single or dual-in-line presentation (both being shown in the drawings).

An advantage to the cap 16 of the present invention and to the overall cable termination assembly 10 is that although the cap 16 is a relatively complex part that requires a relatively complex mold in order to effect plastic injection molding thereof, such molding of a complex part is relatively inexpensive and efficient after the mold has been made because only plastic is molded. Insert molding is unnecessary. The contacts 15 themselves are not molded as part of the cap 16. Moreover, since the cap 16 is formed with relatively complex surfaces, the contacts 15 may be relatively uncomplicated, and this further reduces cost of the cable termination assembly 10.

As will become more apparent from the description below, the cap 16 provides a number of functions in accordance with the present invention. For example, the cap, which also may be considered a cover or a housing, covers or houses part of each of the contacts 15. The cap 16 also provides a positioning function cooperating with the contacts 15 to assure proper positioning thereof both for purposes of manufacturing the cable termination assembly 10 and for use thereof. In connection with the method for making the cable termination assembly 10, the cap 16 temporarily provides a support function serving as a support body for the contacts both during the insulation displacement connection step at which time the junctions 21 are formed and during the molding of the strain relief body 17. The cap 16 also provides guidance for external members, such as pin contacts, which are inserted into cells 20 and cooperates with the contacts 15 to avoid over-stressing of electrical contacts 15. i.e., by limiting deflection of contacting or wiping arms. These and other functions of the cap 16 will be evident from the description herein.

Figure 4:
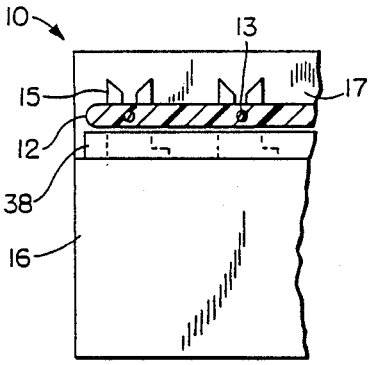
Figure 5:
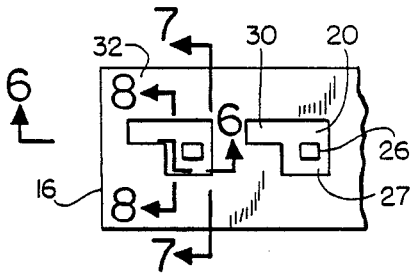
Figure 13:
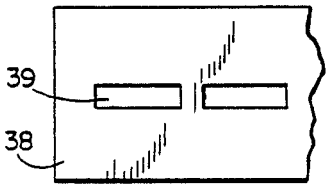
Figure 12:
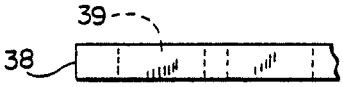

FIGS. 12 and 13 show a shut off strip 38 with openings 39 therein. The openings are configured to fit closely over part of the contacts and to abut the top of the cap 16, as is shown in FIG. 4, to block flow of strain relief molding material into the cells 20 during molding thereof. The top profile of the strip 38 is smaller than that of the cap 16 so molding material can engage part of the cap and the strip to form an integral structure, as is seen in FIG. 4. Alternatively, tape or other means may be used to shut off the cells 20 from strain relief molding material.

Figure 10A:
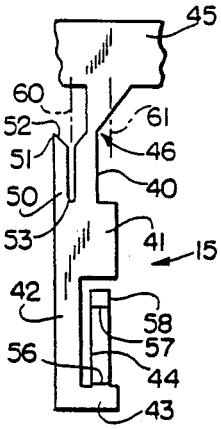
FIGS. 10A and 10B are front and end elevation views of a contact, mounted on a carrier comb, for use in the above assembly.
Figure 10B:
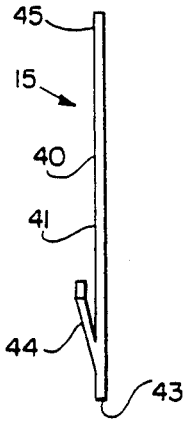

Referring to FIGS. 10A–10B, the electrical contact 15 is illustrated in detail. Preferably, each of the electrical contacts 15 is the same.

Electrical contact 15 includes an IDC terminal portion 40, a base 41, a support leg 42, a cantilever support 43, and a cantilever contacting portion 44. The contact 15, and other identical contacts, may be die cut from a strip of material, and such contacts may be carried by a carrier strip 45 attached at a frangible connection 46 to the contacts in a manner that is well known. The carrier strip 45 is connected to the back end 47 of the contacts proximate the IDC terminal portion 40. The cantilever support 43 is at the front end 48 of the contact 15, and the cantilever contacting portion 44 extends from such cantilever support 43 partly toward the back end 47 terminating prior to reaching the base 41. The contact 15 may be die cut or otherwise cut from strip material, such as berylium copper material, and the various bends and curves in the contact may be formed by stamping the same using generally conventional techniques.

At the back end 47 of the contact 15, the IDC terminal portion 40 may be of relatively conventional design. Such portion 40 includes, for example, a pair of generally parallel legs 50 having pointed tips 51 and sloped surfaces 52 leading to a groove 53 between the legs. The pointed tips 51 may be used to facilitate penetrating the insulation of a cable, and the sloped surfaces 52 guide the cable conductor into the groove 53 for engagement with legs 50 to form an electrical junction 21 therewith.

The base 41 is the same as or may be relatively wider than the IDC terminal portion 40 and has primarily three functions. One of those functions is the joining of the IDC terminal portion 40 and the working end 54 of the contact. The working end 54 includes the support leg 42, cantilever support 43, and cantilever contacting portion 44. The other very important function of the base 41 is to cooperate with the side walls of the opening 34 at the back of each cell 20 and/or with the walls surrounding the openings 39 of the shut off strip 38 to shut off the forward portion of the cell blocking the flow of plastic into the latter during the molding of the strain relief body 17. Accordingly, such base (possibly together with all or part of the IDC portion, or the IDC portion in lieu of the base) provides a shut off for the cap at the respective cells 20 to prevent the molded strain relief material from interfering with the working end 54 of the contact.

Consistent with and enabling performance of the aforementioned functions, the base 41 and/or the IDC portion of the contact fit closely to the walls of the cap and/or shut off strip. Also, the shut off strip preferably engages the top of the cap 16, all this to block flow of strain relief material into the cell 20. Due to the bending of the cantilever contacting portion 44 out of the plane of the support leg 42 and cantilever support 43, in particular, the contact 15 is considered a three-dimensional contact (this as opposed to the generally planar nature of a conventional fork contact disclosed in U.S. Pat. No. 4,030,799 mentioned above).

Figure 6:
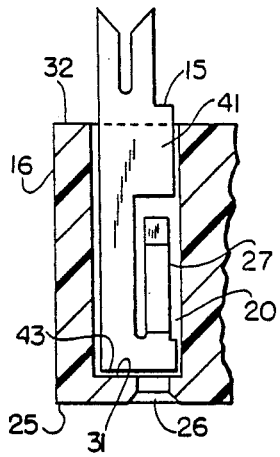

A generally U-shape configuration is defined by the support leg 42, cantilever support 43 and cantilever contacting portion 44, as is seen in FIGS. 6, 10A and 10B. The support leg 42 extends generally linearly from the base 41 but preferably is generally coparallel or coaxial with respect to the linear extent of the IDC terminal portion 40. Such coparallel extent, though, is not a restriction on the contact, and the support leg 42 may be bent to extend non-linearly or otherwise, depending on circumstances and desired use. Nevertheless, the linear extent is preferred in order to facilitate insertion, retention, and positioning relative to the linear extending positioning area 30 in a cell 20 of the cap 16. For the same reasons, the cantilever support 43 preferably extends in generally coplanar relation to the support leg 42. The support leg 42 also preferably fits in close relation to the cell 20 walls bounding the positioning area 30 of the cell, which help to hold the contact 15 in the illustrated position in the cell during IDC connection, molding of the strain relief and use of the cable termination assembly.

Figure 7:
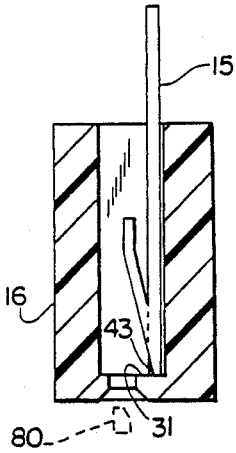

On the other hand, the cantilever contacting portion 44 is bent to extend in cantilever relation out of the plane of the support leg 42 and cantilever support 43, as is seen in FIGS. 7 and 10B, for example. The cantilever contact portion 44 is bent relative to the plane of the cantilever support 43 at a bend 56. A further bend 57 defines a contacting area 58 of the cantilever contacting portion 44 where actual electrical connecting engagement is made with a pin contact or other external member inserted into a cell 20 of the cable termination assembly 10.

The IDC terminal portion 40 is offset relative to the cantilever contacting portion 44, as is seen in FIG. 6, for example. The extent of such offset is represented by the relation of axis line 60 through the center of the groove 53 to the axis line 61, which is drawn along the center of the cantilever contacting portion 44. Such offset relation facilitates relatively closely packing the contacts 15 and use thereof with relatively close-packed or closely positioned conductors 13 in a dual-in-line cable termination assembly arrangement, as is described, for example, in the above-mentioned U.S. Pat. No. 4,030,799. Thus, for example, with the contacts 15 that are adjacent to each other but are in opposite rows of the dual-in-line arrangement as is illustrated in FIG. 3, the IDC terminal portion 40 of one of those contacts would form an electrical junction 21 with one of the conductors 13, and the other of the two contacts illustrated in the cable termination assembly 10 of FIG. 3 would form a junction 21 with a conductor that is immediately adjacent to the previously-mentioned conductor 13; and so on.

Another important advantage of such offset is that force applied to the contact 15 during IDC connection and/or during molding is directed in straight line to the wall surface 31 without affecting the cantilever contacting portion 44, thus avoiding possible damage to the latter.

Figure 8:
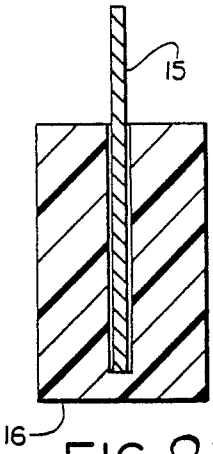
Figure 9:
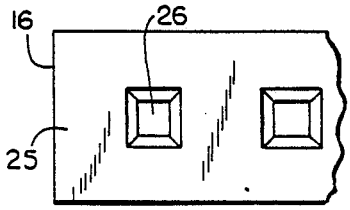

A sub-assembly of electrical contacts 15 and the cap 16 prior to molding of the strain relief body 17 thereto is illustrated in FIGS. 6–8. To assemble such sub-assembly the contacts 15 are inserted into respective cells 20 of cap 16. Such insertion may be facilitated by allowing the plurality of contacts 15 to remain fastened to the carrier strip 45 so that an entire row of contacts may be inserted into an entire row of cells 20, after which the carrier strip 45 may be broken away at the frangible connection 46 and discarded. To insert a contact 15 in a cell 20, the cantilever support 43 is aligned with the opening 34 at the back of a cell such that the support leg 42 is aligned to slide into the positioning area 30 and the cantilever contacting portion 44 is aligned to slide into the contacting area 27 of the cell.

Further insertion of the contact 15 into a cell 20 will place the front end 43 into engagement with the wall surface or land 31 at the front end of the positioning area 30 of the cell 20. Engagement of the contact 15 at the support wall or land 31 enables the latter to support the contact during the insulation displacement connection process described further below and to distribute stress. Moreover, the relatively close fit of the contact support leg 42 and cantilever support 43 in the cell 20 further helps assure correct positioning and support for the contacts and to distribute stress during such IDC step, during molding of the strain relief body 17 and during use of the assembly 10, e.g., as a pin contact is inserted.

Importantly, the base 41 and/or the IDC portion fits rather closely in the opening 39 of shut off strip 38. Any space there is adequately small so that the flow of plastic into the cell 20 will be blocked. For example, the clearance between the contact and walls surrounding opening 39 may be on the order of from about 0.001 to about 0.002 inch. Such clearance is adequately small ordinarily to prevent the flow of plastic down into the cell 20 during molding of the strain relief body 17. The surface of the shut off strip 38 facing the cap 16 preferably seals against the cap to block flow of the strain relief molding material into the cells 20.

Furthermore, due to the relatively close fit of the contact relative to the walls of the opening 34 and opening 39, the relatively close fit of the support leg 42 in the positioning area 30 of the cell 20, and firm engagement of the leading edge of the contact with wall surface 31, such contacts will be held relatively securely both during the IDC step and the injection molding step described further below and will have forces applied to the contacts distributed into the cap 16 and strain relief body 17.

Figure 11:
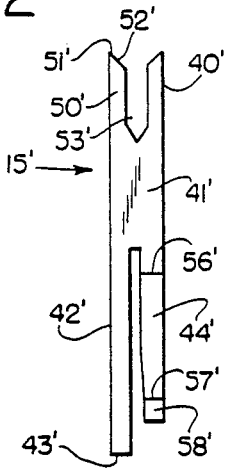
Figure 14:
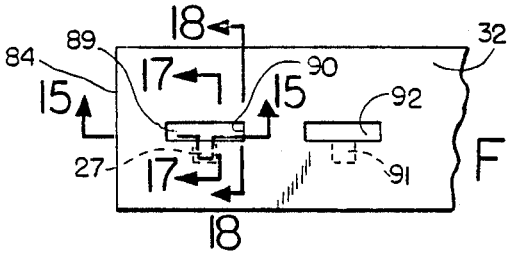

A modified contact 15' is shown in FIG. 11. Such contact 15' is similar to contact 15 of FIGS. 10A, 10B, except that the contacting portion 44' is supported from and extends from the base 41'. In FIG. 11 primed reference numerals designate parts that correspond to those in FIGS. 10A, 10B which are designated by unprimed reference numerals.

Figure 33:
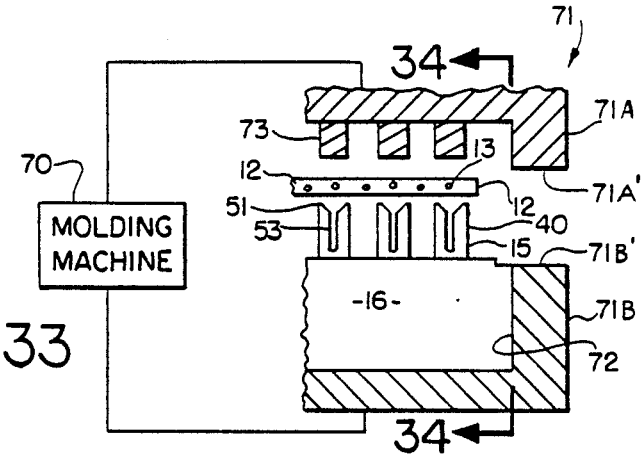
Figure 34:
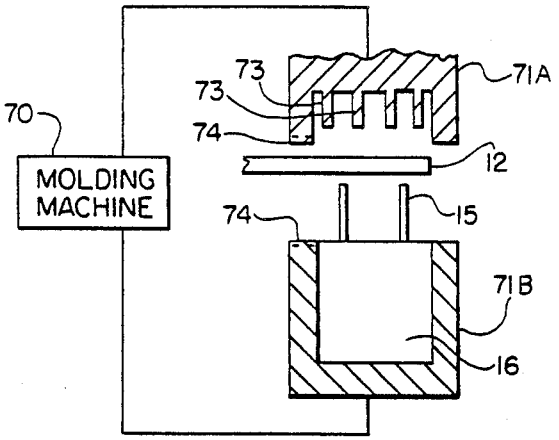

Turning briefly to FIGS. 33 and 34, the apparatus and method for making the cable termination assembly 10 are illustrated. The apparatus is in the form of a molding machine generally designated 70, which includes a mold 71 having an A half 71A and a B half 71B. The mold half 71B has a recess or cavity 72 into which the cap 16 of the cable termination assembly 10 may be placed in relatively close-fitting relation. Preferably, such close fit prevents flow of plastic into the B half of the mold 71 about the sides and ends of the cap. The contacts 15 are installed in the cap 16 either before the cap is placed in the mold half 71B or afterwards. Such contacts are inserted fully into the respective cells 20 to the positions illustrated, for example, in FIGS. 4 and 6–8 to complete the sub-assembly of the contacts 15 and cap 16 described above. The IDC terminal portions 40 of the contacts 15 are exposed for insulation displacement connection with respective conductors 13 of the cable 12 upon closure of the mold 71. In FIG. 33 the illustration is simplified by showing only the contacts 15 in one of the rows of a dual-in-line arrangement otherwise illustrated and described in this application. Two rows of contacts are illustrated in FIG. 34, though, thus demonstrating that the invention may embody one, two or more rows of contacts.

The cable 12 is positioned relative to the IDC terminal portions 40 of the contacts 15 to align the respective conductors above the IDC slots 53, as is seen in FIG. 33. Thereafter, the mold 71 may be closed using hydraulics or other power source of the molding machine 70, bringing the A half 71A and the B half 71B together. As the mold is closed, respective pairs of cores 73 tend to urge the cable 12 toward the IDC terminal portions 40 to force the pointed tips 51 to pierce through the cable insulation 14 and also to force the conductors 13 into respective IDC grooves 53 to make effective electrical connections or junctions between each conductor and a respective contact. During such closure of the mold 71 effecting the mentioned IDC function, the contacts 15 are held relatively securely in the relative positions illustrated in the drawings by the cap 16. The arrangement of cores 73 is seen more clearly in FIG. 34. Each pair of cores 73 presses the cable down toward the aligned respective IDC terminal portion 40 of a given contact. The two cores forming a pair thereof aligned with a respective contact preferably are adequately spaced to allow flow of molding material therebetween as the strain relief body 17 is molded to encapsulate the junction 21.

Grooves at one side of one or both of the A and B halves of the mold are designated 74. Such grooves facilitate passage of the cable 13 between the mold halves when the halves are closed while a tight fit of the mold halves with the cable is made to prevent leakage of molding material during the molding of the strain relief body 17.

With the mold 71 closed a mold cavity is formed bounded in part by the mold halves 71A, 71B and by the back end 32 of the cap 16 and contacts 15 sub-assembly as well as by the shut off strip 38. The molding machine 70 injects plastic or other molding material (which, if desired, may include glass or other reinforcing or filling material) into the mold cavity to form the molded strain relief body 17. Such molding material flows about at least part of the cable, about the IDC terminal portion of the contacts 15, about the junctions 21 of the conductors 13 and contacts 15 (the molding material, accordingly, flowing between the various core pairs 73, as is described in the above-mentioned patent application for "Improved Jumper Connector", Ser. No. 901,762). The molding material also flows about the shut off strip 38 and into engagement with the cap 16.

Upon solidification of the molding material 17 or other curing thereof, the same forms with the cable 13, contacts 15, and cap 16 a substantially integral structure of the cable termination assembly 10. The mold 71 then may be opened to withdraw the cores 73 (leaving the recesses 75 seen in FIG. 2 in the back end of the strain relief body 17) while the junctions 21 remain substantially fully encapsulated and in hermetically sealed relation within the molded strain relief body 17. The cable termination assembly 10 then may be removed from the mold 71, for example, by withdrawing the cap 16 from the recess 72 and the mold half 71B.

According to the preferred embodiment, the material of which the strain relief body 17 is molded and that of which the cable insulation 14 is formed are compatible so that the two bond during the molding step described. Also, preferably the material of which the strain relief body 17 is molded and that of which the cap 16 is made are the same or are compatible to achieve bonding thereof during such molding step described. Further, the temperature at which molding occurs preferably is adequately high to purge or otherwise to eliminate oxygen and moisture from the areas of the junctions 21. Such oxygen-free and moisture-free environment preferably is maintained by a hermetic seal of the junctions 21 achieved by the encapsulation thereof in the strain relief body 17 and helps to prevent electrolytic action at the junctions; therefore, interaction or reaction of the materials of which the conductors 13 and contacts 15 are made, even if different, will be eliminated or at least minimized.

It will be appreciated that the above-described method of making the cable termination assembly 10 effects facile mass termination of the conductors of a multiconductor cable. Since the strain relief body 17 is molded directly to the cap 16, there is no need separately to fasten a cap to a molded strain relief body, e.g., by ultrasonic welding, or the like, as is described in U.S. Pat. No. 4,030,799. Furthermore, since there is no need to effect a separate ultrasonic welding function, relatively less expensive materials, such as re-grind or those including re-grind materials, can be used to make the cap 16 and strain relief body 17, thus reducing the cost for the cable termination assembly 10.

Additionally, it should be understood that the parts of the invention and the method described above enable the IDC step and the molding of a strain relief body essentially to be carried out as part of the same process in making a cable termination or cable termination assembly that uses a three-dimensional contact.

In using the cable termination assembly 10 of the invention, an external member, such as a pin contact 80 (FIG. 7), may be inserted into the opening 26 of one of the cells 20 (or a plurality of such pin contacts or other external members can be inserted simultaneously into respective cells 20). During such insertion the leading end of such pin contact engages the cantilever contacting portion 44 of a contact 15 and tends to push the same slightly out of the way permitting further insertion of the pin contact. The cantilever contacting portion deforms resiliently and tends to wipe against the surface of the inserted pin contact to form a good electrical connection therewith. Such wiping may effect a cleaning of the surfaces of the contacting area 58 of the cantilever contacting portion 44 and the confronting surfaces of the pin contact further to enhance the effectiveness of the electrical connection therebetween.

A feature of the three-dimensional cantilever contact 15 and cooperation thereof with the wall 37 of the cap 16 is that excessive deformation of the cantilever contacting portion 44 by a pin contact 80 cannot bend the cantilever contacting portion beyond engagement thereof with the wall 37; this prevents over-stressing of the contact 15 beyond its elastic limit that could otherwise damage the same. Another feature of the three-dimensional cantilever contact arrangement of the invention is that the electrical connection of the cantilever contacting portion 44 and the pin contact can be made with the burr-free side of the pin contact. (As is known, pin contacts 80 sometimes are made by stamping the same from rolled stock, and it is desirable to effect electrical connections with the burr-free side of such contacts.)

Additionally, in view of the nature of a cantilever-type contact and of the support provided by the wall 37 to prevent over-stressing of the contact, the contacts 15 will have a relatively high level of compliance. Thus, a cable termination assembly 10 in accordance with the invention would be able to tolerate a relatively large degree of mis-alignment or mis-positioning of pin contacts inserted into the respective cells 20 and will be able to accept a relatively large range of sizes of pin contacts, e.g., in terms of cross-sectional size (due to compliance of the contact).

While the invention is illustrated and described above with reference to multiconductor electrical cable termination 11 located at an end of the multiconductor electrical conductor 12, it will be apparent that such a termination also may be provided in accordance with the invention at a location on a multiconductor electrical cable intermediate the ends thereof.

Although the invention has been shown and described with respect to a particular preferred embodiment, it is obvious that equivalent alterations and modifications will occur to others skilled in the art upon the reading and understanding of this specification. Thus, for example only, although the invention has been illustrated and described with respect to a socket type connector, it will be appreciated that features of the invention may be employed in card edge and other types of connectors. Also, the junctions 21 may be other than IDC junctions, such as soldered connections, welded connections, and so on. Further, the contacts 15 may be fork contacts or other contacts that are two dimensional or three dimensional. Additionally, the relation of the contacts 15 with cells 20 may be other than the cooperation of the base 41 and offset 55 thereof with opening 39 to provide the shut off function for a contact containing cell; but, preferably, there should be a cooperative relation of the contact 15 with the cap 16 to effect such shut off and also to provide the described support functions.

A modified cable termination assembly 81 similar to the cable termination assembly 10 is illustrated in FIGS. 14–18. The assembly 10 includes a cable termination 82 and a multiconductor cable 12. The termination includes electrical contacts 83, a cap (support body) 84, and a strain relief 17. The cap 84 is similar to the cap 16 described above; however, the cap 84 is modified to accomodate the contacts 83.

Figure 15:
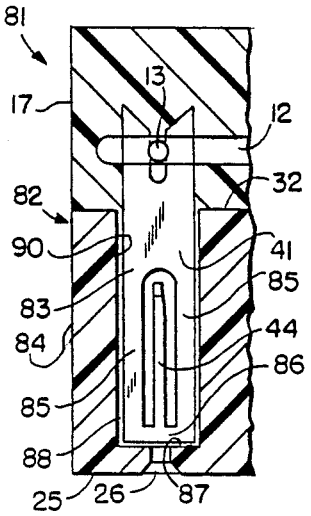
Figure 16:
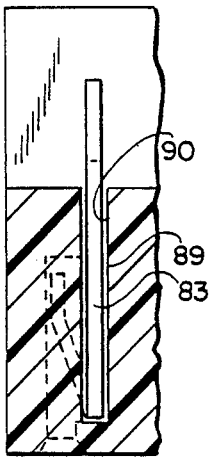
Figure 17:
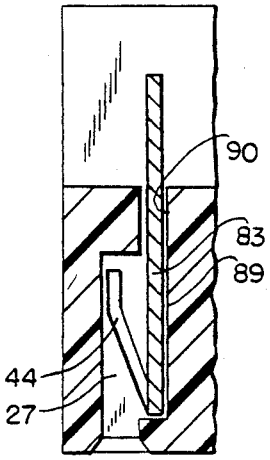
Figure 18:
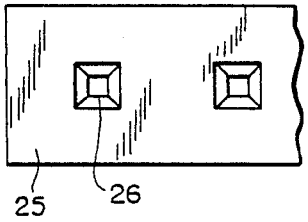

The contacts 83 differ from the contacts 15 in that the contacts 83 have a pair of support legs 85 extending from the base 41, joined by the support arm 86 and having the contacting arm 44 depending from the support arm 86 between the support legs 85 in the manner illustrated in FIG. 15, for example. Such contact 83 has substantial strength in that it has the dual support legs 85 to support the contact against the wall or land 87 (similar in function to the surface 31 described above) in the cap 84 during making of the IDC connections, during molding of the strain relief 17 and during operation of the assembly 81. The base and IDC portions, as well as those portions mentioned just above, are substantially the same in function as the corresponding parts of the contact 15 described above.

The cap 84 includes cells 88 which receive the various portions of the contacts 84, as is illustrated. The cells 88 include openings 26 at the front 25, into which a pin contact or the like may be inserted, a contacting area 27 where the pin contact may make connection with the contacting arm 44, and a positioning area 89 which guides the contact into position in the cap 84 and also cooperates with the base 41 of the contact to shut off the contacting area 27 from molding material during molding of the strain relief material 17. More particularly, the walls 90 surrounding the part of the positioning area near the back 32 of the cap 84 fit closely, e.g. within 0.001 to 0.002 inch, to the contact base 41 to block the flow of strain relief material into the contacting area 27 when the strain relief material is molded.

Importantly, due to the close fit of the contact with the cap walls at the back 32, there should not be a need for any further shut off, such as the shut off strip 38 described above, to block flow of molding material into the contacting area 27 during molding of the strain releif 17. Morover, it is desirable that the contact be adequately compliant, at least insofar as the cantilever contacting arm 44 is concerned, so that the latter can be resiliently bent into coplanar or substantially coplanar relationship with the support legs 85 during insertion of the contact 83 into the cell 88 from the back 32 of the cap 84.

Figure 19:
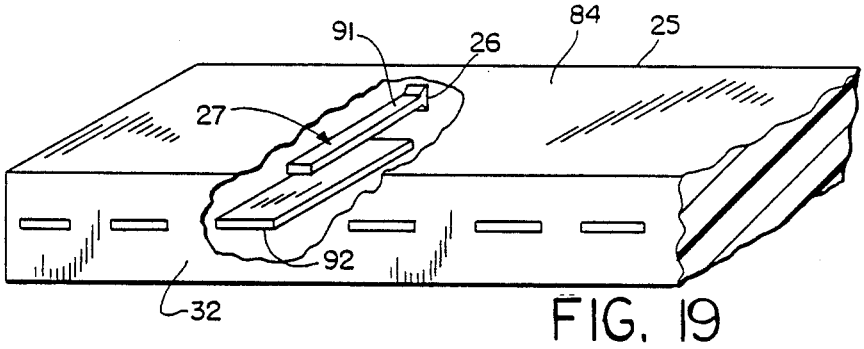
Figure 21:
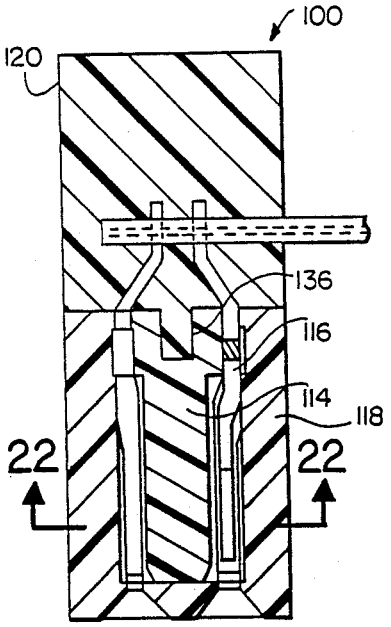
Figure 20:
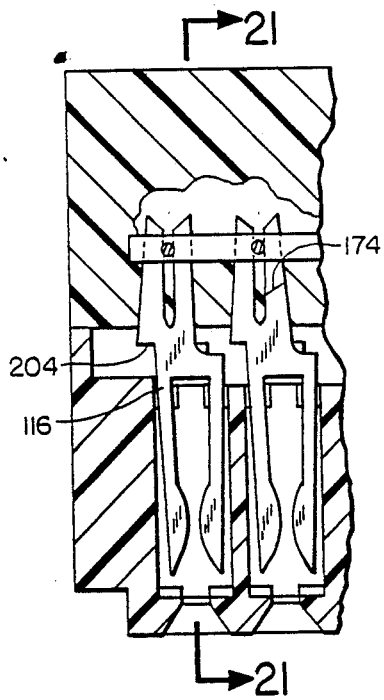
Figure 22:
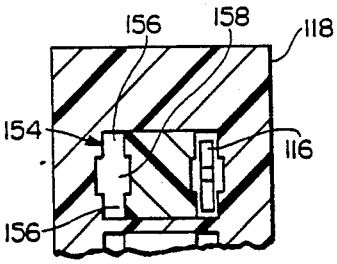
Figure 23:
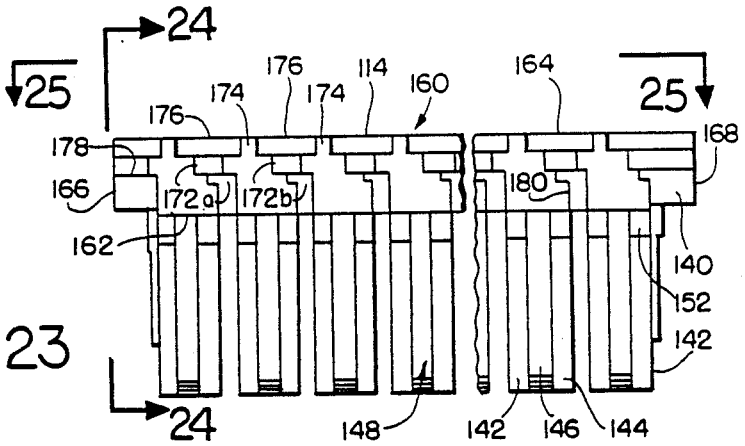
Figure 25:
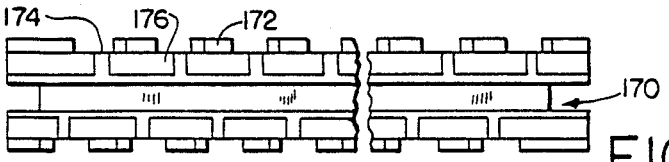
Figure 24:
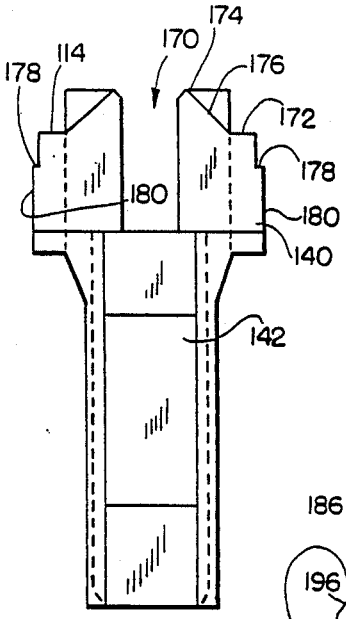

To make the cable termination assembly 81 the cap 84 is molded from electrically non-conductive material, such as plastic. The cap 84 may be molded using a pair of cores in the respective mold halves which form the cored areas 91, 92 illustrated in FIG. 19. Cored area 91 includes the tapered opening 26 into the cell 88 and the contacting area 27. Cored area 92 includes the positioning area 89 of the cell. The cored area 92 opens to the back 32 of the cap 84. The cored areas 91, 92 overlap and interconnect over part of their length in the cap 84 so that the cantilever contacting arm 44 may spring resiliently into that part of the cored area 91 which forms the contacting area 27.

The contacts 83 may be made by conventional die cutting, stamping, etc. processes. The contacts may be loaded into the cap 84 either before or after placing the cap in the mold half 71B. Thereafter, the cable 12 would be aligned with the IDC portions of the contacts and the mold would be closed to complete the IDC connections and to form a mold cavity into which the strain relief material may be injected. Such strain relief material in fact is injected and is allowed to solidify. The mold then is opened and the finished cable termination assembly 81 may be removed and used.

A modified cable termination assembly 100 is illustrated in FIGS. 20–32, including a cable 112, a contact carrier 114, contacts 116, a cover 118, and a molded strain relief 120. A similar cable termination assembly carrier 114, contacts 116 and cover 118 are disclosed in U.S. Pat. No. 4,722,692, the entire disclosure of which hereby is incorporated by reference.

The contact carrier 114 is intended to support and to carry the contacts 116 prior to assembly with the cover 118 and to continue to provide a measure of support for and physical separation of the contacts after assembly with the cover 118 and during use of the cable termination assembly 100. Importantly, the carrier 114 preferably may be snap fit at least partly into the cover 118 and assembled with respect to the cover in such a way to cooperate with the cover to hold the contacts 116 relatively securely while the cable conductors 124 are attached to the contacts 116 and while the strain relief 20 is molded, as is described in further detail below.

The contact carrier 114 is made of electrically non-conductive material, such as polyester material. The contact carrier 114 includes a main body portion 140 and a plurality of finger-like projections 142 that extend from the main body, each projection corresponding to and cooperative with a respective contact 116 or pair of contacts (one on each side) to provide support, positioning, and various other functions with respect thereto, as is described further herein. The main body portion 140 extends generally across the width or lateral dimension of the cable termination assembly 100, and each of the projections 142 projects from the main body portion 140 generally in the axial direction of the cable termination assembly into cover 118.

Each finger-like projection 142 has a pair of relatively raised fork contact tine support/guide surfaces 144 and a relatively recessed pin contact guide surface 146 between the surfaces 144. The contacts 116 are of the fork contact type having a pair of tines, each of which is intended to align generally over a respective support/-guide surface 144. The recessed surface 144 and the space 148 between the surfaces 144 cooperate to guide a pin contact (not shown) or other similar external member to properly aligned physical and electrical engagement with the tines of the contact 116.

To retain the electrical contacts 116 on the top surface 160 of the contact carrier 114, a number of stepped or offset walls generally designated 172 are formed on such surface. Specifically, relatively adjacent stepped walls, such as those designated **172*a*, 172*b* cooperate with a main base portion of a contact placed therebetween to retain the contact in place, as is seen more clearly in FIG. 20. For additional contact positioning function, the tab 174 protrudes out of the latter surface 160 beyond the chamferred plane of sloped walls 176 proximate the axially trailing edge 164 of the carrier 114. The tab 174** fits in a slot between the bifurcated arms of the contact connecting portion.

The sloped walls 176 proximate the axially trailing edge 164 of the contact carrier accommodate a bend in the connecting end of the contacts. Such bend allows the connecting ends of the contacts in both rows to be positioned relatively close to each other to receive the cable conductors 124.

Part of each stepped offset wall 172 is in one plane and part is in another generally parallel plane with a small step 178 separating the two planes. Such step 178 and the relatively raised part 180 of the offset wall 172 are provided to cooperate with a corresponding recessed area in the cover 118 for a snap fit retention of the carrier 114 (and contacts 116 thereon) to the cover 118. It is noted that for simplification of illustration since step 178 is relatively small it does not appear in the illustration of FIG. 25.

Figure 26:
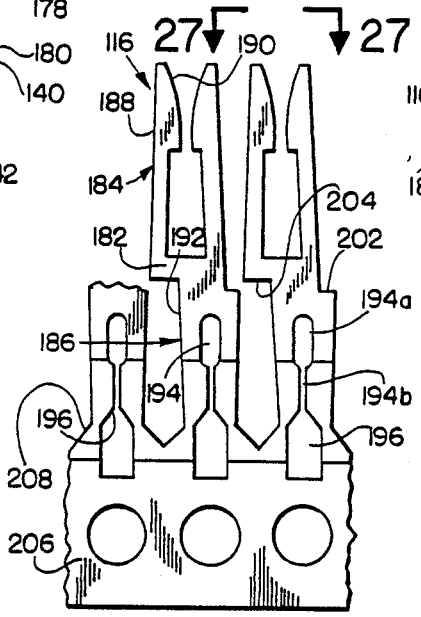
Figure 28:
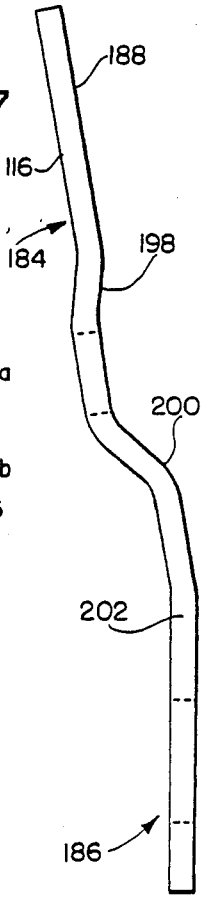
Figure 30:
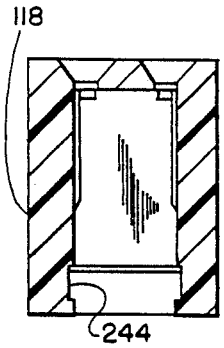
Figure 27:
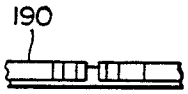
Figure 32:
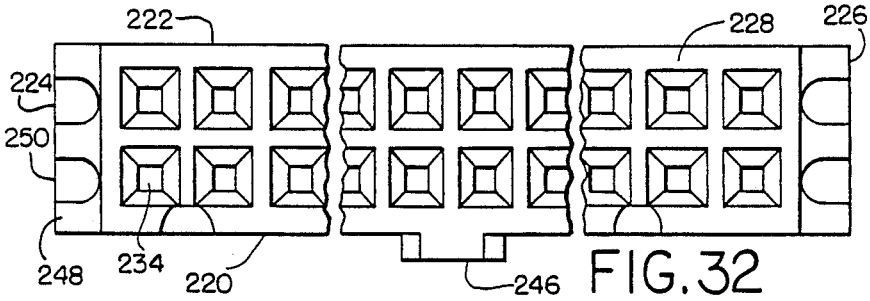
Figure 29:
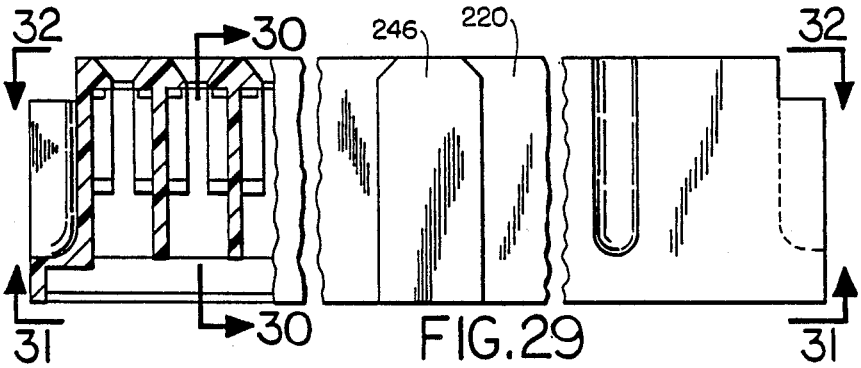
Figure 31:
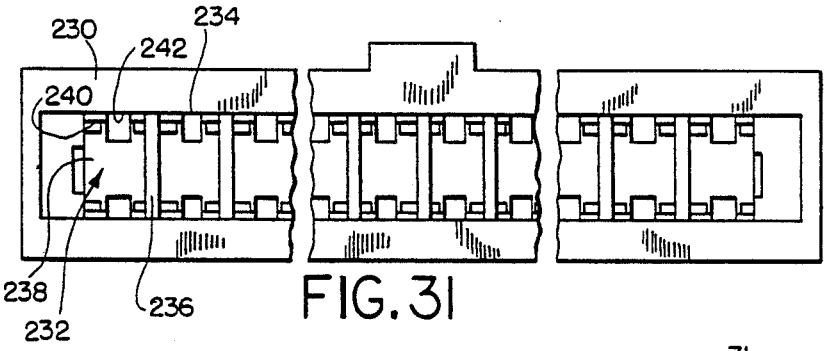

The electrical contacts 116 are shown in detail in FIGS. 26–28. Each contact 116 has a main base portion 182, a contacting portion 184 and a connecting portion 186. The contacting portion 184 includes a pair of generally linearly extending tines 188 as in the case of a typical fork contact, each tine having a curved contacting area 190. A pin contact ordinarily would be inserted between the tines 188 to engage the contacting areas 190 making an electrical connection with the fork contact. The connecting portion 186 extends away from the base 182 generally in the opposite direction from which the contacting portion 184 extends. The connecting portion is bifurcated and includes, a pair of legs 192 defining a slot 194 therebetween. The slot 194 includes a relatively wide portion 194*a* proximate the base 182 for receiving therein a tab 174 of the contact carrier 114 and a relatively narrow 194*b* IDC portion for electrically connecting with a conductor 124.

Preferably each contact 116 has an offset bend 198 at the area where the tines are proximate the base and/or at the base itself to enable the tines to follow relatively closely the sloped wall 176 and the linear walls 144 of the finger-like projections 142 of the contact carrier 114. Also, the contact base 182 and/or legs 192 are bent at 200 to provide the desired following of the shape of the contact carrier 114 and to place the connecting portions 186 of the paired contacts in the two parallel rows thereof relatively proximate each other for IDC connection with the cable 112.

Furthermore, the contacting and connection portions as well as the base portion of the contacts 116 have the illustrated shoulders 202, 204 which together with the generally linearly extending proximate portions of the tines and/or legs 192 cooperate with the stepped offset wall portions 172 of the contact carrier 114 to result in proper positioning and retention of the contacts on the contact carrier 114. Moreover, plural contacts 116 may be attached to a temporary support strip 206 forming a so-called contact comb as was described above regarding contacts 15.

The cover 118 covers the contacting portion of the contacts 116 and cooperates with the contact carrier 114 to form a cross-core cell 154 to constrain movement of the contact tines and to guide a pin contact properly to engagement with the contact tines.

The cover 118 has lateral walls 220, 222, left and right end walls 224, 226, front wall 228, bottom wall 230, and a hollow interior area 232. Openings 234, which are tapered, as shown, provide access for a pin contact to be inserted into the interior of the cover, more particularly to a particular cross core cell 154 for engaging a fork contact 116 therein. Divider walls 236 separate respective adjacent cell pair areas 238 in the interior 232 of the cover 118. Thus, in each cell pair area 238 one of the finger-like projections 142 of the contact carrier 114 is inserted to form a pair of cross-core cells. A shallow recess or groove-like area 242 is formed in the interior faces of the lateral walls 220, 222 to cooperate with the wall or surface 180 of the contact carrier 114 to hold the latter in place in the cover in snap fit relation As part of the process of making the cable termination assembly 100 of the invention, respective combs of contacts 116 are placed on the respective opposite sides of the contact carrier 114 and are held in position thereon as aforesaid; the contact carrier and contacts are then inserted into the cover 118 to the mentioned snap fit relation, thereby forming a contact carrier, contacts, and cover sub-assembly. The temporary contact support strip may be broken off. The contacts 116, carrier 114 and cover 118 cooperate to shut off the cell areas where the contact tines are located to block strain relief material therefrom during molding of the strain relief. The sub-assembly is placed in the mold 71B. The cable is placed in position for IDC connections with the contacts 116. The mold is closed to do the IDC function and then strain relief material is injected into the mold cavity to mold the strain relief 120 to complete the assembly 100. The mold may then be opened and the assembly 100 removed.

The present invention includes all equivalent alterations and modifications, and is limited only by the scope of the following claims.

STATEMENT OF INDUSTRIAL APPLICATION

With the foregoing in mind, it will be appreciated that the cable termination assembly, contact and method described in detail above and illustrated in the drawings may be used to effect electrical interconnections in the electrical and electronics arts.

I claim:

1. An insulation displacement cable termination assembly, comprising an electrical cable having at least one conductor, insulation displacement contact means for effecting electrical connection and having an IDC portion for connection with such conductor and a contacting portion for connection with an external member inserted to engagement therewith, a support body for holding said contact means, strain relief means directly molded to at least part of said contact means, cable and support body to form a substantially integral structure, and means including at least part of said contact means for shutting off flow of molding material of said strain relief means during molding thereof to prevent flow of molding material to said contacting portion of said contact means.

2. The assembly of claim 1, said support body having an opening therein for positioning of at least a part of said contacting means therein, and said means for shutting off comprising a close fit of said contact means with walls of said opening.

3. The assembly of claim 1, said means for shutting off comprising a carrier that carries at least some of said contact means and cooperates with said contact means and said support body to effect such shut off.

4. The assembly of claim 1, said contact means comprising a plurality thereof in plural parallel rows, and said cable comprising a multiconductor cable.

5. The assembly of claim 1, said contact means comprising a three dimensional contact.

6. The assembly of claim 5, further comprising wall means in said support body for cooperating with a portion of said contact means other than said contacting portion thereof for supporting said contact in said support body during IDC connection function and molding of said strain relief without applying stress to said contacting portion.

7. An insulation displacement cable termination assembly, comprising an electrical cable having at least one conductor, insulation displacement contact means for effecting electrical connection and having an IDC portion for connection with such conductor and a contacting portion for connection with an external member inserted to engagement therewith, a support body for holding said contact means, strain relief means directly molded to at least part of said contact means, cable and support body to form a substantially integral structure, and means in said support body for supporting said contacting means during IDC connection and molding of said strain relief to avoid applying stress to said contacting portion.

8. The assembly of claim 7, said contact means comprising a three dimensional contact.

9. The assembly of claim 7, said contact means having plural support legs generally coplanar with said IDC connecting portion, a connector between said legs proximate an end thereof remote from said IDC connecting portion, and said contacting portion extending out of such plane from said connector.

10. The assembly of claim 7, further comprising means for supporting an end part of said contact means in engagement with a wall of said body portion.

11. The assembly of claim 7, further comprising shut off means for preventing flow of strain relief material during molding thereof to said contacting portion.

12. A method of making a cable termination assembly, comprising placing a support body in a mold, placing at least one insulation displacement contact in said support body, aligning a cable with respect to said contact, performing insulation displacement connection of said contact with a respective conductor of such cable, and molding strain relief material directly to at least a portion of said cable, contact and body portion to form an integral structure.

13. The method of claim 12, wherein such contact comprises plural contacts, and such conductor comprises a plurality thereof, and said performing insulation displacement connection comprising connecting respective conductors and contacts.

14. The method of claim 12, further comprising closing such mold to perform insulation displacement connection and to provide a closed mold cavity within which strain relief material may be molded.

15. A cable termination assembly, comprising an electrical cable including at least one conductor, at least one electrical contact, support body means for at least preliminarily supporting said electrical contact, said electrical contact having a connection portion, a contacting portion, and a support between said portions, and said support body means having means for cooperating with said contact support to support said electrical contact during connecting of said connection portion to such conductor and during molding of a strain relief.

16. A cable termination assembly, comprising an electrical cable including at least one conductor, at least one electrical contact, support body means for supporting said electrical contact, and strain relief body means directly molded to at least part of said cable, said electrical contact and said support body means to form an integral structure therewith; said electrical contact having a connection portion for connecting with a said conductor to form a junction therewith, a contacting portion for contacting with an external member when in engagement therewith, and a base portion between said connection and contacting portions, said support body means including means for defining a chamber for said contacting portion, external opening means for permitting insertion of an external member into said chamber for electrical connection with said contacting portion, and means for cooperating with said contact properly to position said contacting portion of said electrical contact in said chamber; said contact including means to cooperate with said support body for supporting said contact during IDC connection and molding of said strain relief body; and said strain relief body means being molded against said support body means at a side thereof opposite said external opening means and over said connection portion and said junction.

17. The assembly of claim 16, wherein said connection portion comprises insulation displacement connection means for IDC connecting with said conductor.

18. The assembly of claim 16, comprising a plurality of electrical contacts, and wherein said cable includes a plurality of conductors connected to respective contacts at respective junctions encapsulated by said strain relief body means.

19. The assembly of claim 18, wherein said cable comprises a multiconductor flat cable.

20. The assembly of claim 16, wherein said electrical contact comprises a three-dimensional contact.

21. The assembly of claim 20, wherein said three-dimensional contact comprises a U-shape contact having a support arm and a cantilever contacting portion.

22. A method of making a cable termination assembly, comprising the steps of placing an electrical contact in a support body portion of the assembly with a contacting portion thereof located in a chamber in the support body portion, the contact also having an insulation displacement connection portion for connection with a conductor to form a junction therewith and a base portion, between the contacting and connection portions positioned to close an end of said chamber, supporting the contact by at least a part of a wall of the chamber in the support body portion, effecting insulation displacement connection of an electrical conductor with the insulation displacement connection portion of the electrical contact, and directly molding a strain relief body to the connection portion of the electrical contact, the junction, the portion of the electrical contact closing an end of said chamber, and the support body portion.

23. The method of claim 22, wherein there are a plurality of electrical contacts and electrical conductors, and said insulation displacement connection effecting step comprises effecting substantially simultaneously insulation displacement connection of a plurality of the electrical contacts with respective electrical conductors, and said molding step comprises molding the strain relief body directly to at least the part of the electrical contacts blocking an end of the chambers for the contacting portions, the support body portion and the conductors.

* * * * *